US005703901A

United States Patent [19]

Ohtani et al.

[11] Patent Number: 5,703,901

[45] Date of Patent: *Dec. 30, 1997

[54] CALCINATION FURNACE

[75] Inventors: Yasuo Ohtani, Yokohama; Takuo Kataho; Makoto Satoh, both of Akita-ken; Tsutomu Tanaka, Chiba; Yoshimasa Nose, Funabashi; Kazuyoshi Kobayashi, Akita-ken; Tetsuhide Uchikawa, Shizuoka-ken; Toshihiro Hamahata, Sakura, all of Japan

[73] Assignee: TDK Corporation, Tokyo, Japan

[ * ] Notice: The term of this patent shall not extend beyond the expiration date of Pat. No. 5,559,826.

[21] Appl. No.: 664,340

[22] Filed: Jun. 14, 1996

Related U.S. Application Data

[63] Continuation of Ser. No. 80,570, Jun. 21, 1993, Pat. No. 5,559,826.

[30] Foreign Application Priority Data

| | | | |
|---|---|---|---|
| Jun. 23, 1992 | [JP] | Japan | 4-188763 |
| Sep. 14, 1992 | [JP] | Japan | 4-271216 |
| Oct. 20, 1992 | [JP] | Japan | 4-306418 |

[51] Int. Cl.[6] ..... H05B 3/00

[52] U.S. Cl. ..... 373/109; 373/111; 219/406; 432/34; 432/175

[58] Field of Search ..... 373/109, 111, 373/45, 27, 30–32, 42–44, 112, 122, 20; 219/406, 388, 390; 432/34, 175

[56] References Cited

U.S. PATENT DOCUMENTS

| | | | |
|---|---|---|---|
| 2,126,881 | 8/1938 | Gatzke | 219/388 |
| 3,414,661 | 12/1968 | Reed | 373/111 |
| 4,145,563 | 3/1979 | Rabinovich et al. | 373/45 |
| 4,444,558 | 4/1984 | Kinto | 432/225 |
| 5,559,826 | 9/1996 | Ohtani et al. | 373/109 |

FOREIGN PATENT DOCUMENTS

| | | |
|---|---|---|
| 0306837 | 9/1988 | European Pat. Off. . |
| 971009 | 1/1951 | France . |
| 61-17888 | 1/1986 | Japan . |
| 61-86585 | 5/1986 | Japan . |
| 61-216728 | 9/1986 | Japan . |
| 61-252481 | 11/1986 | Japan . |
| 62-10588 | 1/1987 | Japan . |
| 62-17591 | 1/1987 | Japan . |
| 63-48789 | 3/1988 | Japan . |
| 63-73086 | 4/1988 | Japan . |
| 63-151688 | 6/1988 | Japan . |
| 63-210593 | 9/1988 | Japan . |
| 63-267882 | 11/1988 | Japan . |
| 63-302291 | 12/1988 | Japan . |
| 739304 | 10/1955 | United Kingdom . |
| 2176593 | 5/1985 | United Kingdom . |

*Primary Examiner*—Tu B. Hoang
*Attorney, Agent, or Firm*—Price, Gess & Ubell

[57] ABSTRACT

A calcination furnace capable of variably setting calcination conditions such as a size of a calcination chamber, a temperature, a temperature distribution and flowing of gas in the calcination chamber; and the like depending on calcined intermediate products. A furnace body in which a furnace chamber is defined includes two movable sections, which are moved in predetermined directions, to thereby vary an internal volume of the furnace chamber as desired.

30 Claims, 11 Drawing Sheets

CALCINATION FURNACE

This is a continuation case of Ser. No. 08/080,570 now U.S. Pat. No. 5,559,826, filed Jun. 21, 1993.

BACKGROUND OF THE INVENTION

1. Field of the Invention

This invention relates to a calcination furnace, and more particularly to a furnace for calcining a ceramic product.

2. Description of Revelant Art

In general, a ceramic product used for various kinds of electronic circuit elements is manufactured by mixing a ceramic powder with an organic binder to prepare an intermediate product and then subjecting it to calcination in a calcination furnace. The calcination furnaces include a continuous furnace for mass production and a batch furnace for mass production, as well as a test furnace and the like. Such a conventional calcination furnace is generally constructed so that a furnace chamber in which an intermediate product to be calcined (hereinafter referred to as "calcined intermediate product" or "intermediate product") is subjected to calcination is defined in a furnace body invariably or fixedly constructed. Thus, an internal volume of the furnace chamber is kept fixed.

This results in the conventional calcination furnace failing to vary a size of the furnace chamber to variably set conditions for calcination such as a calcination temperature, a temperature distribution, a flow rate of gas and the like depending on a calcined intermediate product.

In the conventional calcination furnace, a heater utilizing combustion of fuel such as oil or gas (hereinafter referred to as "combustion heater") and an electric heater are used as a heat source for calcination. The combustion heater is decreased in running cost as compared with the electric heater. The combustion heater generally employs a direct heating system of carrying out combustion of fuel in the furnace chamber in which a calcined intermediate product is placed when the intermediate product is not affected by combustion gas produced due to combustion of fuel, whereas it employs an indirect heating system when the calcined intermediate product is adversely affected by the combustion gas.

The indirect heating system is classified into a radiant tube system and a muffle construction system. The radiant tube system is constructed so as to burn fuel in a plurality of heat-resistant cylinders or tubes. The heat-resistant tubes each are formed of a metal or ceramic material and inserted through the furnace body into the furnace chamber. The muffle construction system has a muffle furnace body formed of a heat-resistant metal or refractory material so as to define the furnace chamber or calcination chamber and introduce combustion gas produced in a combustion furnace provided separate from the muffle furnace body into the calcination chamber to heat an intermediate product placed in the calcination chamber.

Unfortunately, the radiant tube system requires to arrange a number of radiant tubes to cause an extensive increase in cost of equipment. Also, it has another disadvantage of failing to provide uniform heat transfer, even when the radiant tubes are arranged at an increased cost described above in such a manner that a distance between a wall surface of the furnace chamber and the radiant tubes exceeds a diameter of the radiant tube. In the muffle construction system, when the muffle furnace body is made of a heat-resistant metal material, a service temperature of the furnace body is limited to 900° C. or below in view of its heat-resistance. The calcination at a higher temperature requires that the furnace body is formed of refractory bricks into an arch-like shape, resulting in being labor- and time-consuming and increased in cost.

Further, when the combustion heater is used as the heat source, a heat exchange system is generally employed. The heat exchange system uses a heat exchanger as a means for improving heat efficiency, so that heat exchange is carried out between combustion gas produced due to combustion of fuel and combustion air fed to the combustion heater for combustion to preheat the combustion air, followed by feeding the preheated combustion air to a burner constituting the combustion heater. The conventional heat exchange system is so constructed that the heat exchanger is arranged outside the calcination furnace and the heat exchanger and calcination furnace are connected to each other through pipings. Unfortunately, connection between the heat exchanger arranged separate from the calcination furnace and the calcination furnace through the pipings causes the pipings to be complicated in construction. Also, this deteriorates heat efficiency due to discharge of heat from the pipings.

Further, in view of an operation manner of the calcination furnace, the calcination furnace is classified into a continuous furnace and a batch furnace. The continuous calcination furnace is mainly used for mass production, whereas the batch calcination furnace is used for mass production, as well as used as a test furnace for determining calcination conditions for the continuous calcination furnace. The continuous calcination furnace is so operated that a plurality of calcined intermediate products are charged in a furnace chamber and calcined while being transferred from one side of the furnace to the other side thereof. Therefore, the continuous furnace causes a variation in temperature to occur between the intermediate products being transferred in the furnace chamber. On the contrary, the batch furnace is adapted to calcine the intermediate products in a furnace chamber while keeping them stationary therein, to thereby prevent occurrence of such a variation in temperature between the intermediate products as encountered with the continuous furnace. Also, the batch furnace is constructed so as to minimize a variation in temperature in the furnace chamber.

Thus, it is impossible to correspond the continuous furnace and batch furnace to each other. For example, calcination conditions determined for the continuous furnace are not applied to the batch furnace; whereas use of the batch furnace as a test furnace for determining calcination conditions for the continuous furnace fails to provide accurate calcination conditions for the continuous furnace.

Controlling of an atmosphere in the calcination furnace is carried out in a manner to continuously feed fresh gas for the atmosphere to the furnace chamber while exhausting the atmosphere. The fresh gas is introduced into the furnace chamber at a temperature as close as a room temperature, resulting in the atmosphere in the furnace chamber being locally cooled to adversely affect calcination conditions, leading to a variation in quality or characteristics of final products which have been subjected to calcination (hereinafter referred to "final calcined products"). Also the exhaust gas is discarded regardless of a large amount of thermal energy contained therein.

SUMMARY OF THE INVENTION

The present invention has been made in view of the foregoing disadvantages of the prior art.

Accordingly, it is an object of the present invention to provide a calcination furnace which is capable of permitting a size or internal volume of a furnace chamber defined in a furnace body to be variably set depending on a calcined intermediate product.

It is another object of the present invention to provide a calcination furnace which is capable of variably setting calcination conditions depending on a calcined intermediate product.

It is a further object of the present invention to provide a calcination furnace which is capable of determining calcination conditions suitable for a continuous calcination furnace for mass production.

It is still another object of the present invention to provide a calcination furnace which is capable of exhibiting increased heating efficiency.

It is yet another object of the present invention to provide a calcination furnace which is capable of being effectively used as an indirect heating type calcination furnace, to thereby carry out uniform heat transfer and exhibiting increased heating efficiency while minimizing large-sizing of the furnace.

It is even another object of the present invention to provide a calcination furnace which is provided with a heat exchange system so as to permit the furnace to exhibit increased heat efficiency without causing the furnace to be complicated in construction.

It is a still further object of the present invention to provide a calcination furnace which is capable of taking the form of a batch calcination furnace effectively corresponding it to a continuous calcination furnace.

It is an even further object of the present invention to provide a calcination furnace which is capable of effectively utilizing or recycling atmosphere gas which has been conventionally discarded without adversely affecting calcination conditions.

In accordance with one aspect of the present invention, a calcination furnace is provided. The calcination furnace includes a furnace body in which a furnace chamber is defined. The furnace body includes at least one movable section. The movable section is moved to adjust an internal volume of the furnace chamber.

Such construction, when calcined intermediate product is formed into a large size, permits the movable section to be moved, to thereby vary the furnace chamber to a size suitable for the calcined intermediate product.

In a preferred embodiment of the present invention, the furnace chamber includes a first furnace chamber section constituting a calcination chamber and at least one second furnace chamber section. The second furnace chamber section includes a combustion heater means and is arranged adjacent to the calcination chamber and partitioned from the calcination chamber through a heat transfer partition.

Thus, the calcination chamber is not affected by combustion gas of the combustion heater means, so that an atmosphere in the calcination chamber may be adjusted so as to have a composition suitable for calcination. Also, separation of the combustion chamber from the calcination chamber through the heat transfer partition prevents excessive large-sizing of the furnace and facilitates temperature equalization in the calcination chamber.

In a preferred embodiment of the present invention, the calcination furnace further comprises a combustion heater means for heating the furnace chamber, and a heat exchange means incorporated into the furnace body so as to carry out heat exchange between combustion air introduced into the furnace chamber and combustion gas discharged from the furnace chamber.

Such construction significantly reduces a running cost of the calcination furnace and permits thermal energy contained in the combustion gas to be utilized to heat combustion air. Also, incorporation of the heat exchange means into the furnace body eliminates a necessity of arranging between the heat exchange means and the furnace body, to thereby simplify the structure of the furnace and improve heat efficiency.

In a preferred embodiment of the present invention, the furnace chamber includes at least one furnace chamber section. The furnace chamber section is divided into a plurality of regions in which calcined intermediate products are received. The regions are arranged so as to cause heat interference to occur among the regions. The regions are provided therein with heat source units, respectively, which are driven while exhibiting time-temperature characteristic patterns in which exotherm is varied with time so as to cause a time delay to occur among the time-temperature characteristic patterns.

Thus, the calcination furnace may be constructed into a batch structure.. Also, the above-described construction of the preferred embodiment permits a difference in temperature to occur between calcined intermediate products, so that the calcination furnace accomplishes calcination in a heat pattern similar to a continuous furnace irrespective of being the batch type.

In a preferred embodiment of the present invention, the calcination furnace further comprises a furnace atmosphere control unit which includes a furnace atmosphere circulating section. The furnace atmosphere circulating section is constructed so as to adjust a concentration of ingredients contained in a furnace atmosphere taken out from the furnace body and adjust a temperature of the furnace atmosphere to a level approximating a furnace temperature in the furnace body before the furnace atmosphere is returned to the furnace body.

Thus, when the furnace atmosphere contains ingredients produced from a calcined intermediate product, the furnace atmosphere is returned to the furnace body after the ingredients are removed therefrom. Also, necessary ingredients such as combustion air in the furnace atmosphere is insufficient, the replenishment is carried out. Also, the preferred embodiment effectively prevents local cooling or heating in the furnace chamber, to thereby eliminate a variation in calcination conditions for calcined intermediate products and a variation in characteristics of final calcined products.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference numerals designate like or corresponding parts throughout; wherein.

DETAILED DESCRIPTION OF THE PREFERRED EMBODIMENTS

Now, a calcination furnace according to the present invention will be described hereinafter with reference to the accompanying drawings.

Figure 1:
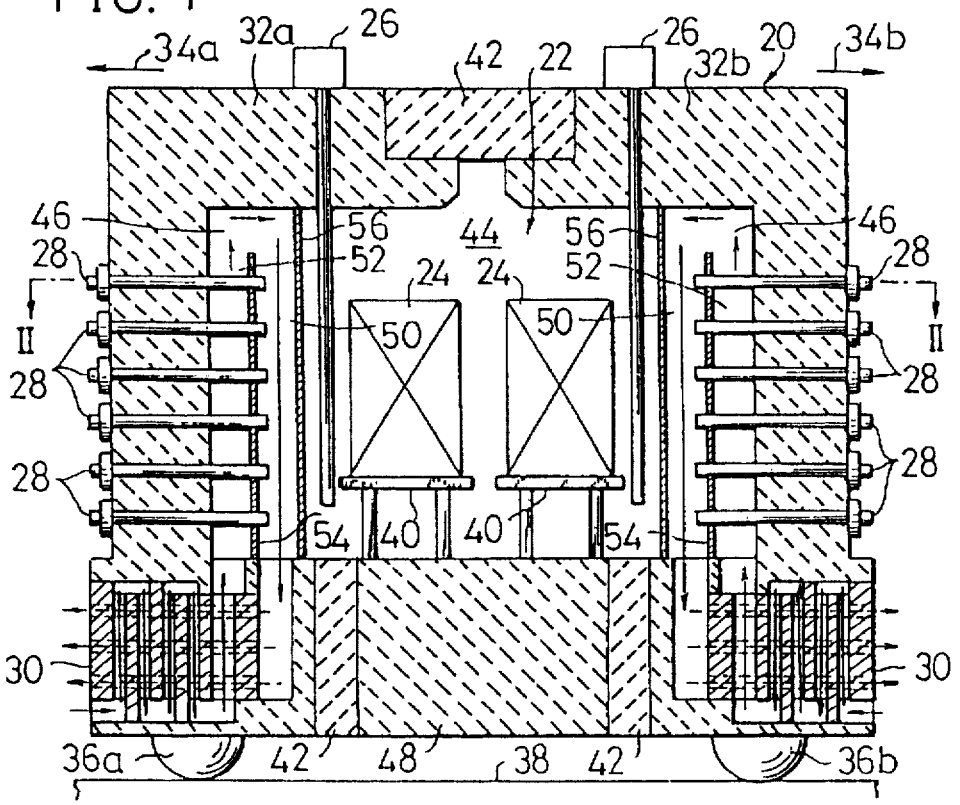
FIG. 1 is a vertical sectional front elevation view showing one embodiment of a calcination furnace according to the present invention.
Figure 2:
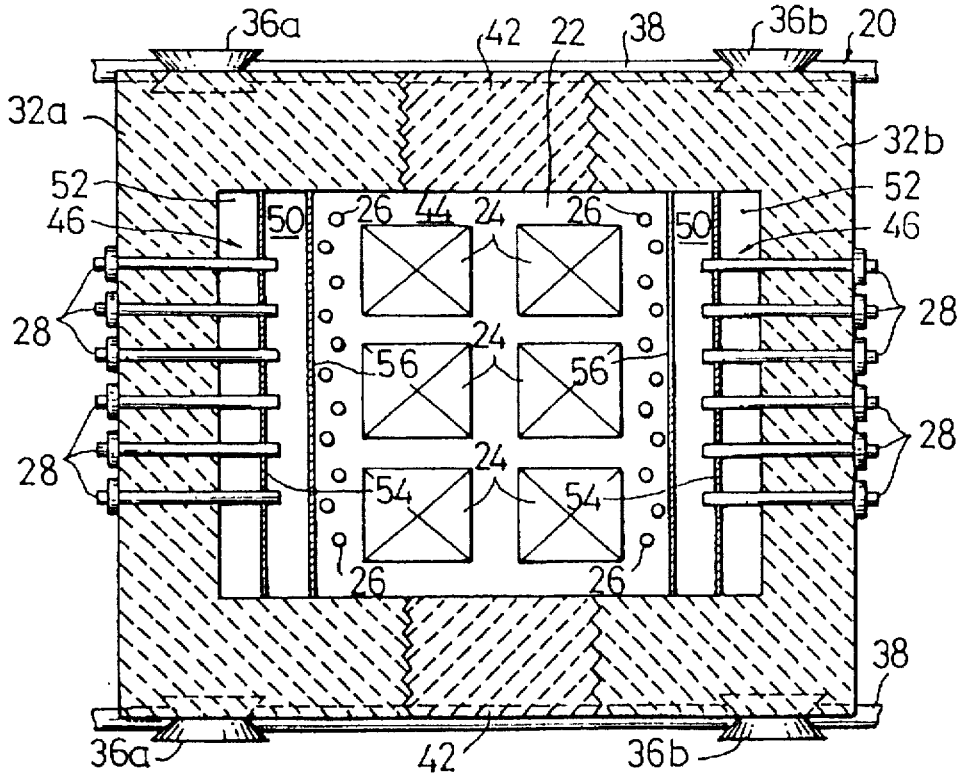
FIG. 2 is a sectional plan view taken along line II—II of FIG. 1.

Referring first to FIGS. 1 and 2, an embodiment of a calcination furnace according to the present invention is illustrated. A calcination furnace of the illustrated embodiment generally includes a furnace body 20 in which a furnace chamber 22 is defined. The furnace chamber 22 is adapted to receive or house calcined intermediate products 24 which are intermediate products to be calcined therein for calcination. The calcination furnace also includes first heat source units 26, second heat source units 28 and heat exchange units 30. The furnace body 20 in which the furnace chamber 22 is defined is made of a refractory material such as refractory bricks or the like. The furnace body 20 includes at least one movable section. In the illustrated embodiment, two such movable sections **32*a* and 32*b* are arranged. The movable sections 32*a* and 32*b* are adapted to be movable in directions indicated at arrows 34*a* and 34*b*, so that a size or internal volume of the furnace chamber 22** may be varied depending on the calcined intermediate products as desired.

The directions in which the movable sections **32*a* and 32*b* of the furnace body 22 are moved are selected to be perpendicular to a direction in which a temperature gradient is formed in the furnace chamber 22. The temperature gradient will be described hereinafter. In the illustrated embodiment, the movable sections 32*a* and 32*b* are arranged on both sides along a longitudinal direction of the furnace body 20, so that a width of the furnace chamber 22 may be variably adjusted. The movable sections 32*a* and 32*b* are provided on a bottom thereof with a pair of rollers 36*a* and a pair of rollers 36*b*, respectively, which are adapted to travel on a pair of rails 38. The calcined intermediate products 24 each are a shaped ceramic product containing a binder such as an organic binder, which is placed in a heat-resistant casing. The intermediate products 24 are received in the furnace chamber 22 while being put on a heat-resistant pedestal support 40**.

Figure 3:
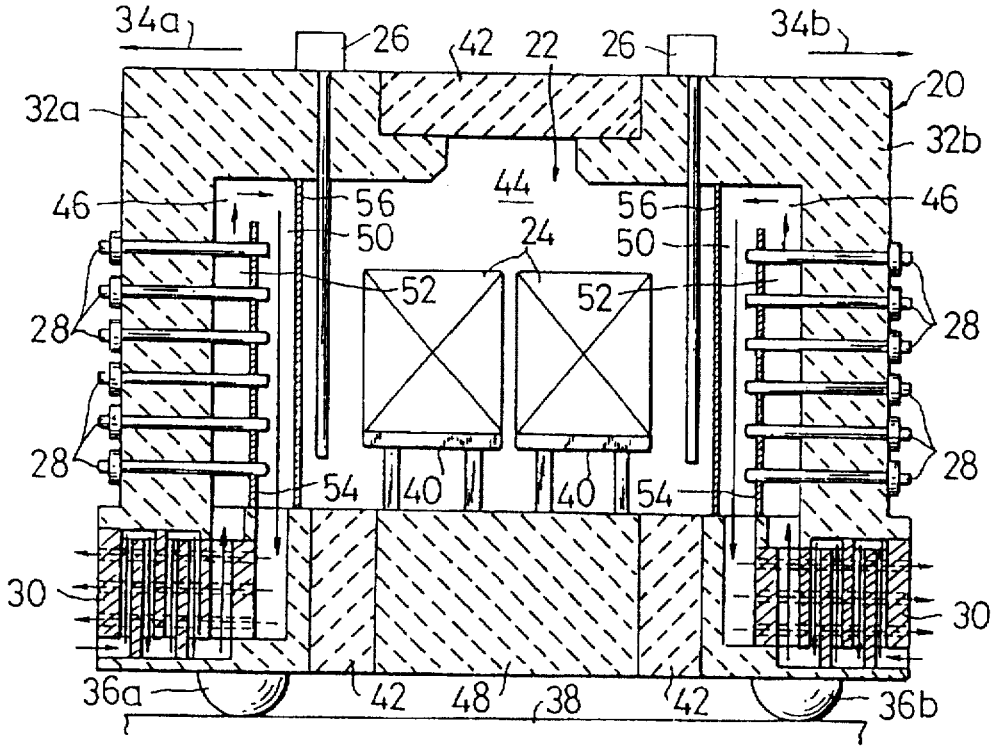
FIGS. 3 is a vertical sectional front elevation view of the calcination furnace shown in FIG. 1 which has been subject to width adjustment.

As described above, the furnace body 20 is provided with at least one movable section and more specifically two movable sections **32*a* and 32*b*, so that the internal volume of the furnace chamber 22 may be variably adjusted due to movement of the movable sections 32*a* and 32*b* depending on a size of the calcined intermediate products 24. Thus, as shown in FIG. 3, controlled movement of the movable sections 32*a* and 32*b* permits calcination conditions such as a size of the furnace chamber 22, a temperature, a temperature distribution and flowing of gas in the furnace chamber 22, and the like to be conformed to conditions set depending on a side of the calcined intermediate products. For example, when the calcined intermediate products 24 have a large size, the movable sections 32 and 32*b* are moved so as to correspond the internal volume of the furnace chamber 22** to that of a continuous furnace. This is also applied to the case that the number of calcined intermediate products is increased.

The directions of movement of the movable sections **32*a* and 32*b*, as described above, are selected to be perpendicular to the direction in which a temperature gradient is formed in the furnace chamber 22, so that a degree of temperature equalization of the calcined intermediate products may be adjusted by adjusting movement of the movable sections 32*a* and 32b*b***.

The furnace body 20 also includes a space adjusting means 42 for adjusting a variation in space or width in the furnace chamber 22 due to movement of the movable sections **32*a* and 32*b*. The space adjusting means 42 is made of a refractory material. Reference numeral 48 designates a bottom of the furnace body 20, which is fixedly arranged. The space adjusting means 42, when the movable sections 32*a* and 32*b*** are moved to cause a space therebetween to be increased as shown in FIG. 3, is incorporated in the furnace body to compensate an increased portion of the space. Thus, the space adjusting means which has dimensions corresponding to a size of the increased portion is selectively used for this purpose.

The furnace chamber 22 is divided into a first furnace chamber section 44 and second furnace chamber sections 46 through partitions 56 arranged so as to extend in the longitudinal direction of the furnace body 20, resulting in the second chamber sections 46 being defined on both sides of the first chamber 44 in the longitudinal direction of the furnace body 20. The first heat source units 26 are arranged in the first furnace chamber section 44 and the second heat source units 28 are arranged in each of the second furnace chamber sections 46. The first heat source units 26 are used as a main heat source for providing heat required for calcination of the calcined intermediate products 24 and the second heat source units 28 are used as a backup heater. A predetermined number of such first heat source units 26 and second heat source units 28 are provided. Such construction permits a required number of the second heat source units 28 to be driven in order to obtain a required thermal output, to thereby set or determine calcination conditions in view of a different in heat reserve of the furnace body. In other words, the calcination furnace of the illustrated embodiment may be used for a simulation test for determining calcination conditions for a continuous furnace. Also, the construction permits calcination conditions such as drying, rise in temperature, temperature equalization, cooling and the like to be determined as desired.

Preferably, the first heat source units 26 each comprise an electric source and the second heat source units 28 each comprise a combustion heater such as a gas burner, an oil burner or the like. Use of a combustion heater as the second heat source unit significantly reduces a thermal energy cost as compared with sole use of the electric source.

The first furnace chamber section 44 constitutes a calcination chamber and the second furnace chamber sections 46 each are divided into a combustion chamber 50 and an air feed path 52 through a partition 54. The calcination chamber constituted by the first furnace chamber section 44 is separated from the combustion chamber 50 of each of the second furnace chamber sections 46 through each of partitions 56. In the illustrated embodiment, the partitions 54 and 56 each are made of a heat transfer material. Such separation of the calcination chamber 44 from the combustion chamber 50 permits an atmosphere in the calcination chamber 44 to be readily controlled and prevents combustion operation of the second heat source units or combustion heaters 28 from adversely affecting the calcined intermediate products 24 in the calcination chamber 44, to thereby provide final calcined products with satisfactory quality. Also, such separation prevents a variation in combustion operation of the second heat source units 28 from adversely affecting calcination conditions, particularly, an oxygen concentration in the calcination chamber 44. Further, heating of the calcination chamber by the combustion heaters 28 is indirectly carried out through the partitions 56, so that removal of a binder from the calcined intermediate product may be uniformly accomplished to minimize deterioration in quality of the final calcined product due to cracking or the like. The air feed path 52 acts to feed combustion air from an ambient atmosphere therethrough to the combustion chamber 50. In the illustrated embodiment, at least a part of the remaining portion of the wall of the calcination chamber 44 other than the partition 56 may be a reflection wall.

As will be apparent from the foregoing, in the illustrated embodiment, the combustion heaters 28 are arranged on both sides of the furnace body 20. Also, the second furnace chamber sections 46 each are so constructed that the combustion chamber 50 is arranged adjacent to the calcination chamber 44 and the air feed path 52 is arranged opposite to the calcination chamber 44 through the combustion chamber 50 interposed therebetween. Therefore, air flowing through the air feed path 52 toward the combustion chamber 50 is pre-heated to a sufficiently elevated temperature by combustion heat produced by the combustion heaters 28 arranged in the combustion chamber 50, to thereby facilitate complete combustion in the combustion chamber even when the amount of combustion is kept at a low level. Also, such arrangement permits the combustion operation to be carried out at a low air ratio, to thereby substantially improve heat efficiency.

As described above, the calcination furnace of the illustrated embodiment is so constructed that movement of at least one movable section permits an internal volume of the furnace chamber to be varied as desired, resulting in calcination conditions such as a size of the calcination chamber; a temperature gradient, a temperature distribution, flowing of gas in the furnace Chamber; and the like being determined in conformity to calcined intermediate products.

Also, in the illustrated embodiment, the furnace chamber 22 is divided into the first and second furnace chamber sections 44 and 46 and the heat source includes the first heat source units 26 arranged in the first furnace chamber section 44 and the second heat source units 28 arranged in the second furnace chamber sections 46. Thus, selective driving of the second heat source units permits calcination conditions to be suitably determined depending on a capacity of heat reserve of a calcination furnace intended.

Further, the calcination chamber constituted by the first furnace chamber section 44 is separated from the second furnace chamber sections 46 in which the second heat source units 28 are arranged, so that a furnace atmosphere or an atmosphere in the calcination chamber 44 may be controlled without being adversely affected by combustion operation of the second heat source units or combustion heaters 28, to thereby provide final calcined products with satisfactory quality.

Figure 4:
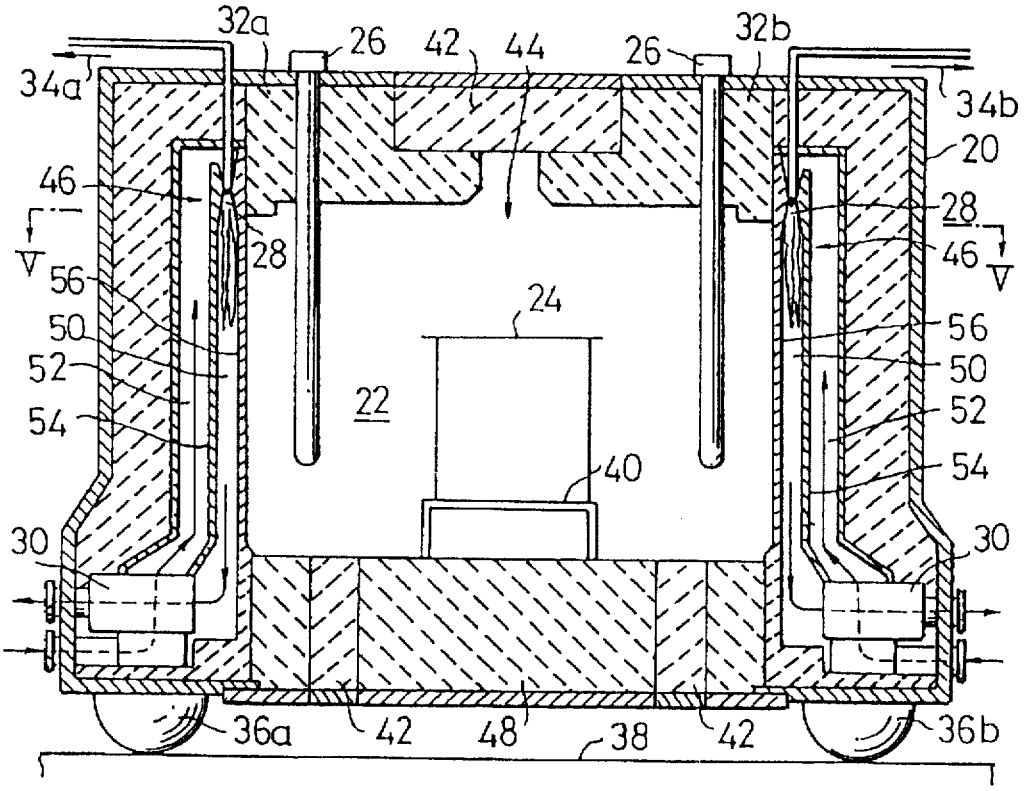
FIG. 4 is a vertical sectional front elevation view showing a modification of the calcination furnace of FIG. 1.
Figure 5:
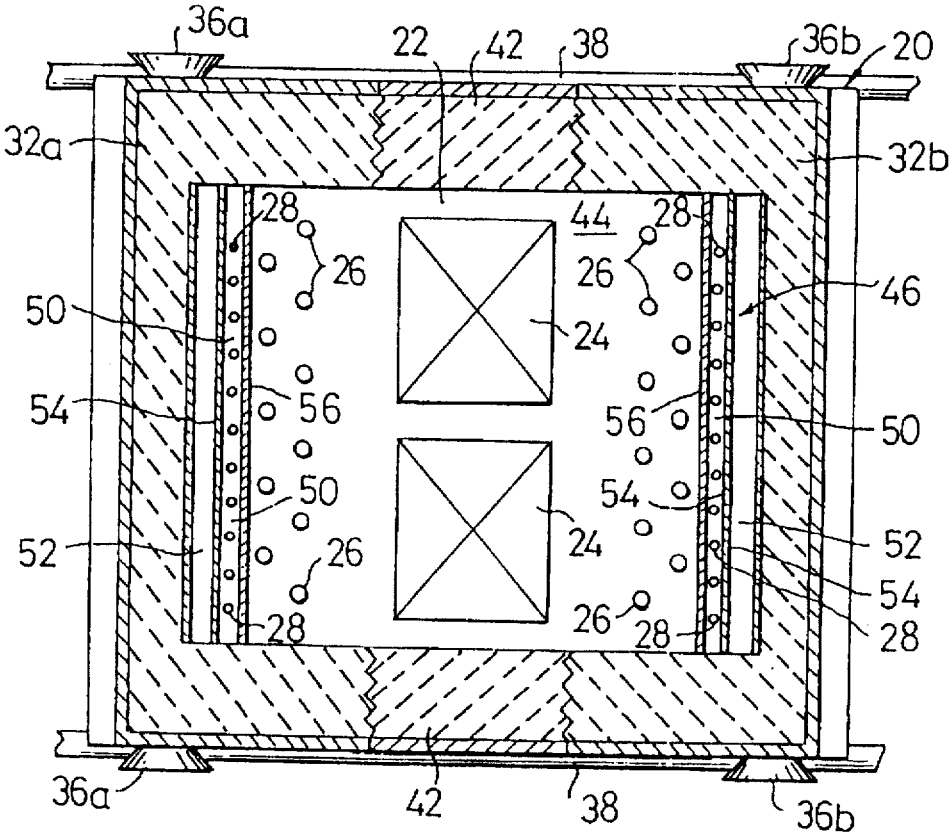
FIG. 5 is a sectional plan view taken along line V—V of FIG. 4.

FIGS. 4 and 5 show a modification of the calcination furnace described above with reference to FIGS. 1 to 3.

In the modification, a second furnace chamber section 46 is provided on at least one of both sides of a first furnace chamber section 44 constituting a calcination chamber and is separated from a first furnace chamber section 44 through a partition 56 which is made of a material of heat transfer properties as well as heat-resistant properties and forms a part of a wall of the calcination chamber 44. Such construction facilitates temperature equalization in the furnace chamber and therefore calcined intermediate products 24 while improving heat efficiency without causing significant large-sizing of the furnace body, unlike the conventional radiant tube system described above. The temperature equalization and heat efficiency are further promoted by arranging the second furnace chamber section 46 on each of both sides of the first furnace chamber section or calcination chamber 44. The heat transfer partition 56 is arranged so that an area thereof preferably accounts for at least 40% of that of the wall of the calcination chamber 44. Such arrangement improves heat equalization of the calcined intermediate products 24, to thereby minimize deterioration of quality of final calcined products even when a temperature variation is increased, resulting in an economical advantage being exhibited. At least a part of the remaining portion of the wall of calcination chamber other than the partition 56 may comprise a reflection wall.

Further, the modification shown in FIGS. 4 and 5 is constructed in such a manner that second heat source units or combustion heaters 28 are arranged on the side of a ceiling of a furnace body 20. Such construction permits the number of second source units 28 to be reduced as compared with the embodiment shown in FIGS. 1 to 3. The remaining part of the modification may be constructed in substantially the same manner as the calcination furnace shown in FIGS. 1 to 3.

Thus, as will be noted from the foregoing, the calcination furnace of the modification is so constructed that the second furnace section which provides both a combustion chamber 50 and an air feed path 52 is provided on at least one side of the calcination chamber 44 and separated from the calcination chamber through the heat transfer partition 56 which forms a part of the wall of the calcination chamber 44. Such construction exhibits, in addition to the advantages of the embodiment shown in FIGS. 1 to 3, an advantage of significantly improving temperature equalization and heat efficiency without causing excessive large-sizing of the furnace body. Also, in the modification, an area of the heat transfer partition may be selected to account for at least 40% of that of the wall of the calcination chamber 44, so that heat equalization of the calcined intermediate products may be highly increased to ensure satisfactory quality of the final products irrespective of an increase in velocity of a temperature variation. Further, the second heat source units 28 are arranged on the side of the ceiling of the furnace body 20, resulting in the number of second source units 28 being significantly reduced.

The calcination furnace of the illustrated embodiment, as shown in FIGS. 1, 3 and 4, may be provided with a heat exchange unit 30 for carrying out heat exchange between combustion air introduced into the air feed path 52 of each of the second furnace chamber sections 46 and combustion gas discharged from the combustion chamber 50. The heat exchange unit 30 may he provided in correspondence to the second furnace chamber section 46. Therefore, in the illustrated embodiment, two such heat exchange units are arranged.

Figure 6:
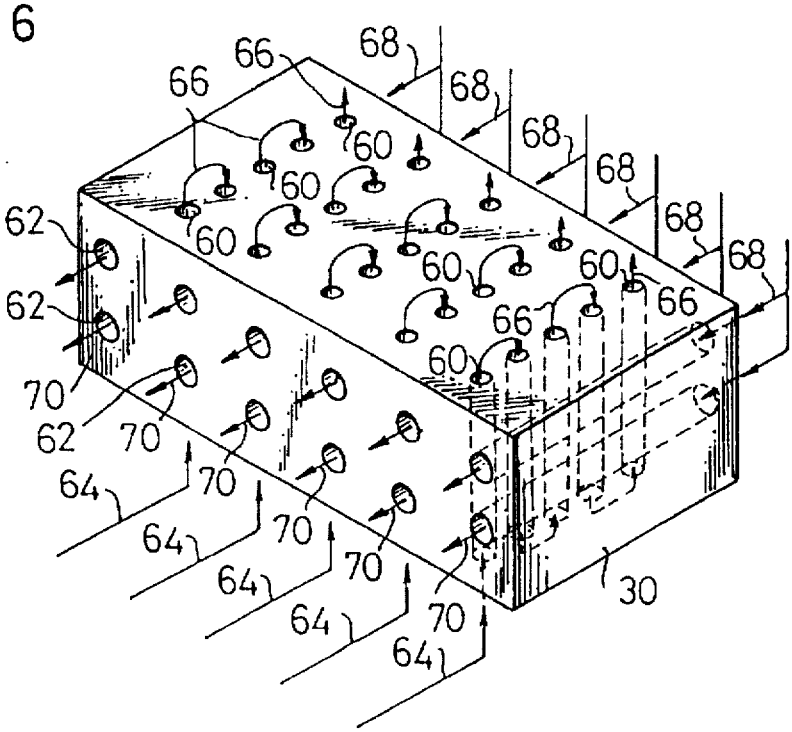
FIG. 6 is a perspective view showing one example of a heat exchange unit suitable for use in the present invention.

The heat exchange unit 30 may be constructed in such a manner as best seen in FIG. 6. More particularly, the heat exchange unit 30 is incorporated in the furnace body 20 and includes combustion air passages 60 for guiding, to each of the second furnace chamber sections 46, combustion air used for combustion in the second furnace chamber section 46 and combustion gas passages 62 for guiding combustion gas produced in the second furnace chamber section 46 so as to outwardly discharge it from the second furnace chamber section. The combustion air passages 60 are arranged so as to communicate with an ambient atmosphere and the second furnace chamber section 46 and the combustion gas passages 62 are arranged so as to be adjacent to the combustion air passages 60. The combustion air passages 60 are arranged in a plurality of rows in such a manner that the passages 60 of each row are in parallel to each other in one direction to form a serial path indicated at arrows 64 and 66 and the respective rows of the passages 60 are in parallel to each other in the other direction perpendicular to the one direction. Combustion gas produced in the second furnace chamber section 46 is introduced into the combustion gas passages 62 as indicated at arrows 68 and discharged therefrom as indicated at arrows 70. In the illustrated embodiment, the combustion gas passages 62 each are arranged so as to extend perpendicular to the combustion air passages 60.

Figure 7:
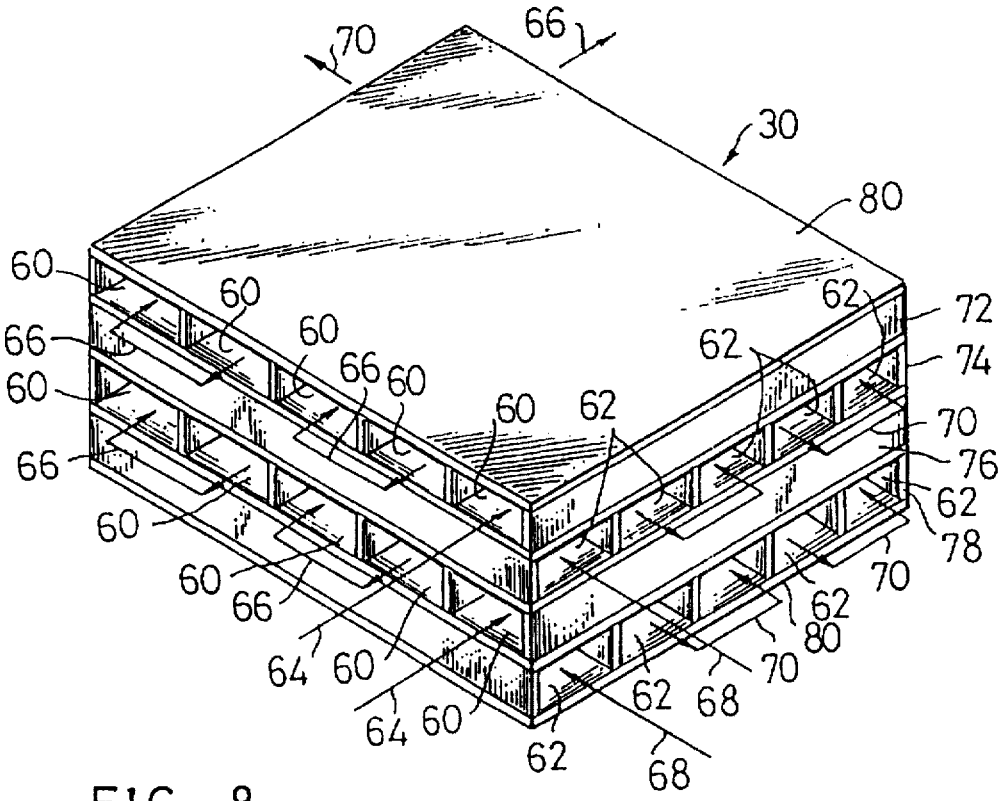
FIG. 7 is a perspective view showing another example of a heat exchange unit suitable for use in the present invention.

In the illustrated embodiment, the combustion air passages 60 and combustion gas passages 62 each comprise a through-hole formed via a block. Alternatively, they may be formed by combining a plurality of plate members. FIG. 7 shows an example of such construction, wherein combustion air passages 60 and combustion gas passages 62 are formed by a combination of plates members 72, 74, 76, 78 and 80 each made of a heat-resistant material.

Thus, the heat exchange units 30 each function to carry out heat exchange between combustion air introduced into the second furnace chamber section 46 and combustion gas discharged therefrom, so that thermal energy contained in the combustion gas may be effectively utilized to heat the combustion air.

Also, the heat exchange units 30 are incorporated in the furnace body 20, to thereby eliminate arrangement of pipings between the heat exchange unit 30 and the second furnace chamber section 46. This results in the calcination furnace being simplified in structure and heat dissipation being significantly reduced as compared with the conventional calcination furnace, to thereby improve heat efficiency.

Figure 8:
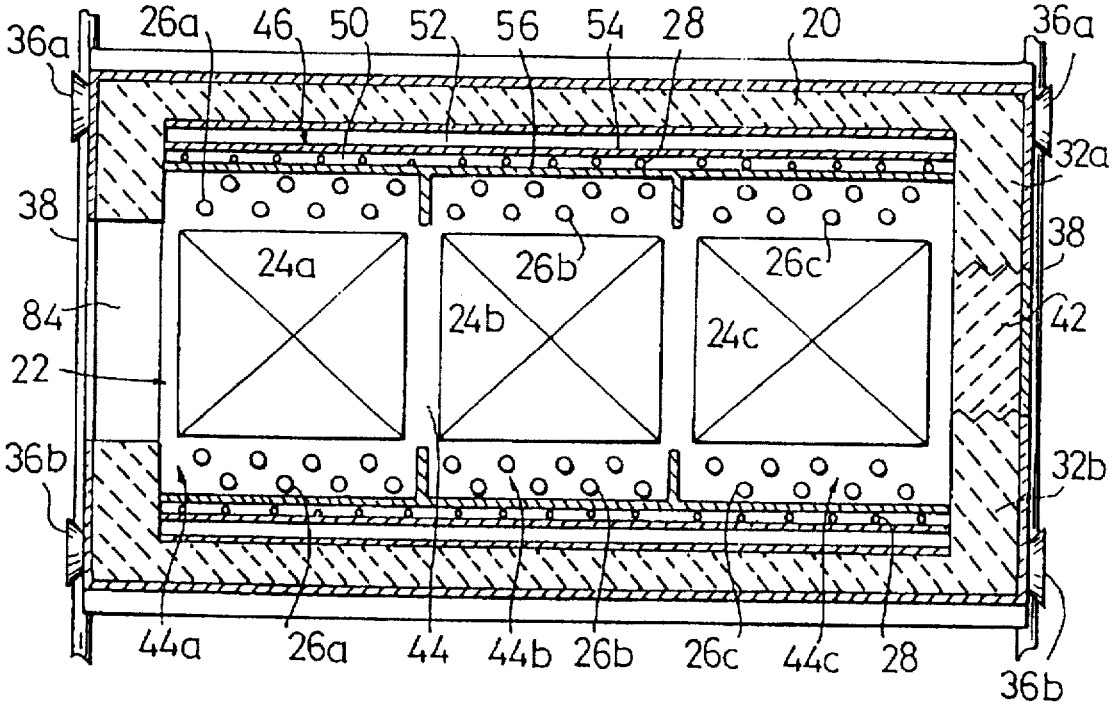
FIG. 8 is a cross-sectional plan view showing another embodiment of a calcination furnace according to the present invention.

Referring now to FIG. 8, another embodiment of a calcination furnace according to the present invention is illustrated. A calcination furnace of the illustrated embodiment is in the form of a hatch type calcination furnace as described below and includes furnace body 20 in which a furnace chamber 22 is defined and first heat source units **26*a*,26*b*,26*c*. The furnace chamber 22 includes a first furnace chamber section 44 in which calcined intermediate products 24*a*,24*b* and 24*c* are placed. The calcined intermediate products 24*a* to 24*c* are introduced into the furnace chamber 22 through an entrance 84**.

The first furnace chamber section 44 are divided into three regions **44*a*, 44*b* and 44*b*. The regions 44*a* to 44*c* are arranged so as to cause heat interference to occur therebetween and adapted to receive the calcined intermediate products 24*a* to 24*c* therein while keeping them stationary, respectively. The three regions 44*a* to 44*c* are arranged in a row and so as to communicate with each other in turn, resulting in heat interference occurring between the regions. The first furnace chamber section 44** is desirably divided into three or more such regions.

Figure 10:
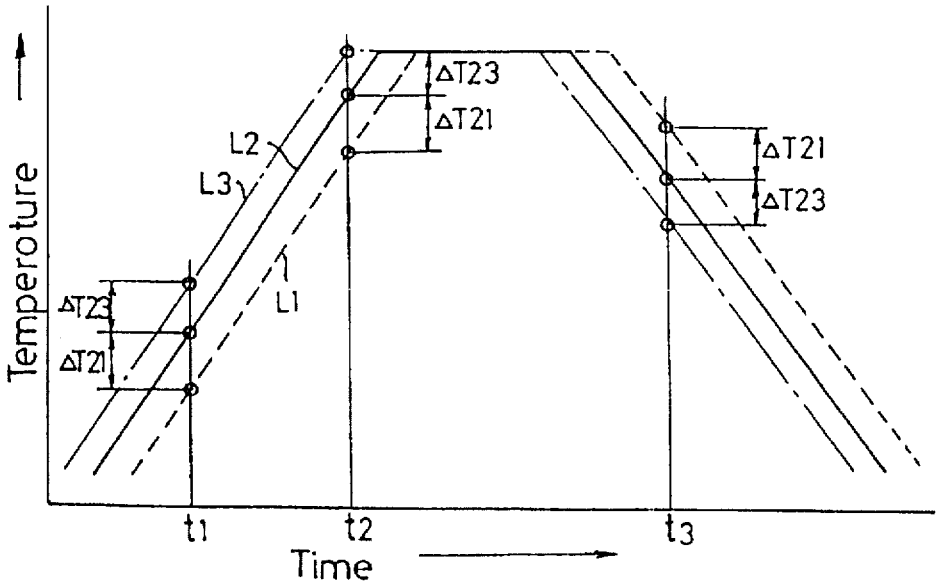
FIG. 10 is a graphical representation showing time-temperature characteristics of the calcination furnace shown in FIG. 8.

The first heat source units **26*a* to 26*c* are arranged in the regions 44*a* to 44*c*, respectively. The first heat source units 26*a* to 26*c* are driven while exhibiting time-temperature characteristic patterns L1 to L3 wherein an exotherm or temperature is varied with time in a manner to cause a time delay to occur among the patterns L1 to L3 as shown in FIG. 10, respectively. In FIG. 10, an axis of abscissae indicates time and an axis of ordinates indicates a temperature. The time-temperature characteristic patterns L1, L2 and L3 are patterns of the first heat source units 26*a*, 26*b* and 26*c* arranged in the regions 44*a*, 44*b* and 44*c*, respectively. The time-temperature characteristic patterns L1 to L3 have approximate characteristics and are set in relationships in which parallel displacement is carried out with time. Temperatures of the calcined intermediate products 24*a* to 24*c* and those of the regions 44*a* to 44*c* do not completely coincide with the time-temperature characteristic patterns L1 to L3. However, the following description will be made supposing that the coincidence is established therebetween. A suitable heater such as an electric heater, a gas heater, an oil burner or the like may be used for each of the first heat source units 26*a* to 26*c***. Preferably, an electric heater is used therefor, because it is simplified in temperature adjustment.

As described above, the first furnace chamber section 44 of the furnace chamber 22 is divided into three regions **44*a* to 44*c* in which the calcined intermediate products 24*a* to 24*c* are placed, respectively. The regions 44*a* to 44*c*** are arranged so as to cause heat interference to occur therebetween, resulting in the calcination furnace being of the batch type.

As described above, the calcination furnace of the illustrated embodiment is so constructed that the first furnace chamber section 44 is divided into a plurality of regions **44*a* to 44*c* which are arranged so as to cause heat interference to occur therebetween and the first heat source units 26*a* to 26*c* are provided in the regions 44*a* to 44*c*, respectively. Also, in the illustrated embodiment, the first heat source units 26*a* to 26*c* are driven while exhibiting the time-temperature characteristic patterns L1 to L3 in a manner to cause a time delay to occur among the time-temperature characteristic patterns L1 to L3. Such construction of the illustrated embodiment permits the calcined intermediate products 24*a* to 24*c* placed in the regions 44a to 44c to be heated while being subject to a temperature difference due to heat interference among the regions 44a to 44c and a time delay among the time-temperature characteristic patterns L1 to L3. For example, when time t1 in the course of rising of the temperature in FIG. 10 is noted, temperature differences ΔT21 and ΔT23 occur between the time-temperature characteristic pattern L2 of the first heat source unit 26b and the time-temperature characteristic pattern L1 of the first heat source unit 26a and between the time-temperature characteristic pattern L2 of the first heat source unit 26b and the time-temperature characteristic pattern L3 of the first heat source unit 26c, respectively. The calcined intermediate products 24a and 24c in the regions 44a and 44c are heated while being subject to the temperature differences ΔT21 and ΔT23 with respect to the calcined intermediate product 23b in the region 44b. This is likewise applied to the remaining time regions such as, for example, times t2 and t3 (FIG. 10) other than constant-temperature regions in which the patterns L1 to L3 overlap with each other. Thus, the calcination furnace of the illustrated embodiment permits the calcined intermediate products to be calcined in a heat pattern similar to a continuous furnace irrespective of being a batch type, resulting in being corresponded to a continuous furnace. Further, the illustrated embodiment may be constructed in such a manner that the regions 44a to 44c of the first furnace chamber section 44** are arranged in a row in one direction and the heat source units are driven so as to cause the time delay to occur in the direction of arrangement of said heat source units.

The remaining part of the illustrated embodiment may be constructed in substantially the same manner as the above-described embodiment.

Figure 9:
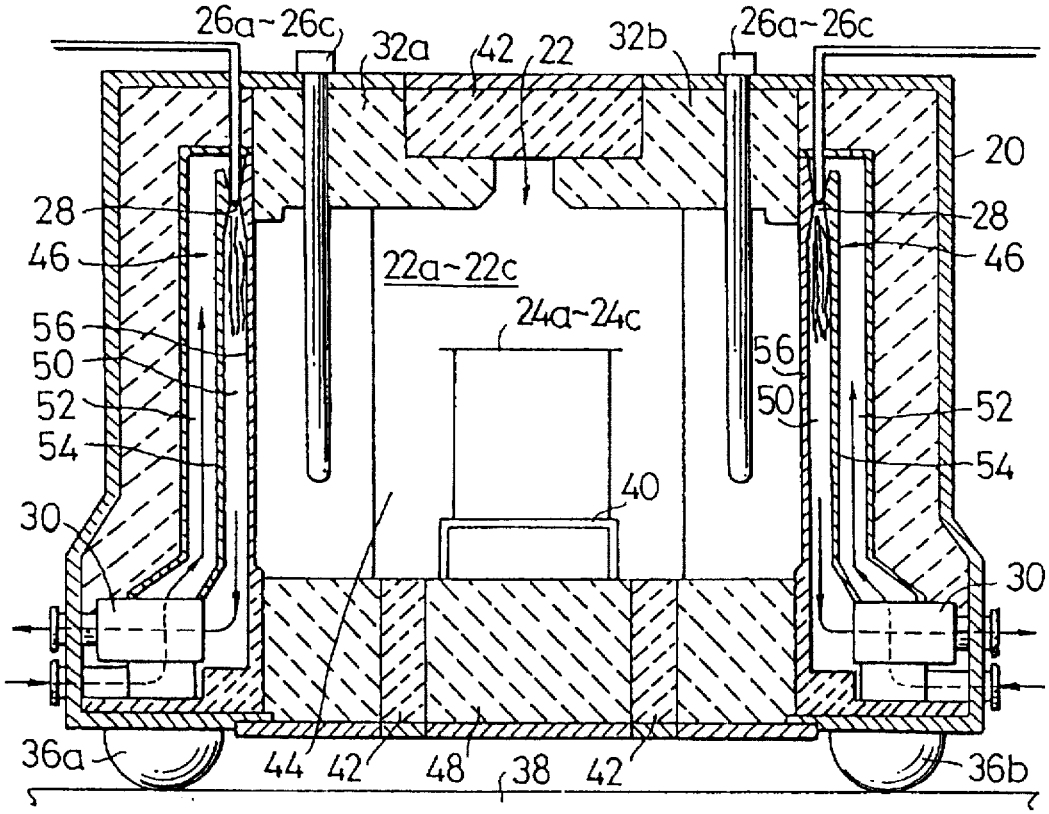
FIG. 9 is a vertical sectional front elevation view showing a modification of the calcination furnace of FIG. 8.

FIG. 9 shows a modification of the embodiment shown in FIG. 8, wherein reference numeral 46 designates second furnace chamber sections, 28 designates second heat source units or combustion heaters, and 30 designates heat exchange units. The combustion heaters 28 are arranged in the second furnace chamber sections 46. The second furnace chamber sections 46 each are arranged adjacent to the first furnace chamber section 44 and partitioned from the first furnace chamber section 44 through a refractory partition 56. Alternatively, a furnace body 20 may be constructed in a conventional manner or in such a manner that both furnace chamber sections 44 and 46 are not partitioned from each other. The combustion heaters 28 each may comprise a gas burner, an oil burner or the like. The remaining part of the modification may be constructed in substantially the same manner as the embodiment shown in FIG. 8.

Thus, the embodiment of FIGS. 8 and 9, the first furnace chamber section 44 of the furnace chamber 22 is constructed so as to receive the calcined intermediate products while keeping them stationary therein, so that the calcination furnace may be constructed into a batch-type structure. Also, the first furnace chamber section 44 is divided into three regions 44a to 44c, which are arranged so as to cause heat interference to occur between the regions and the first heat source units 26a to 26c are arranged in the regions 44a to 44c, respectively. Further, the heat source units 26a to 26c are driven while exhibiting time-temperature characteristic patterns in which exotherm is varied with time so as to cause a time delay to occur among the patterns. Thus, the calcination furnace of the embodiment may be corresponded to a continuous furnace.

Figure 11:
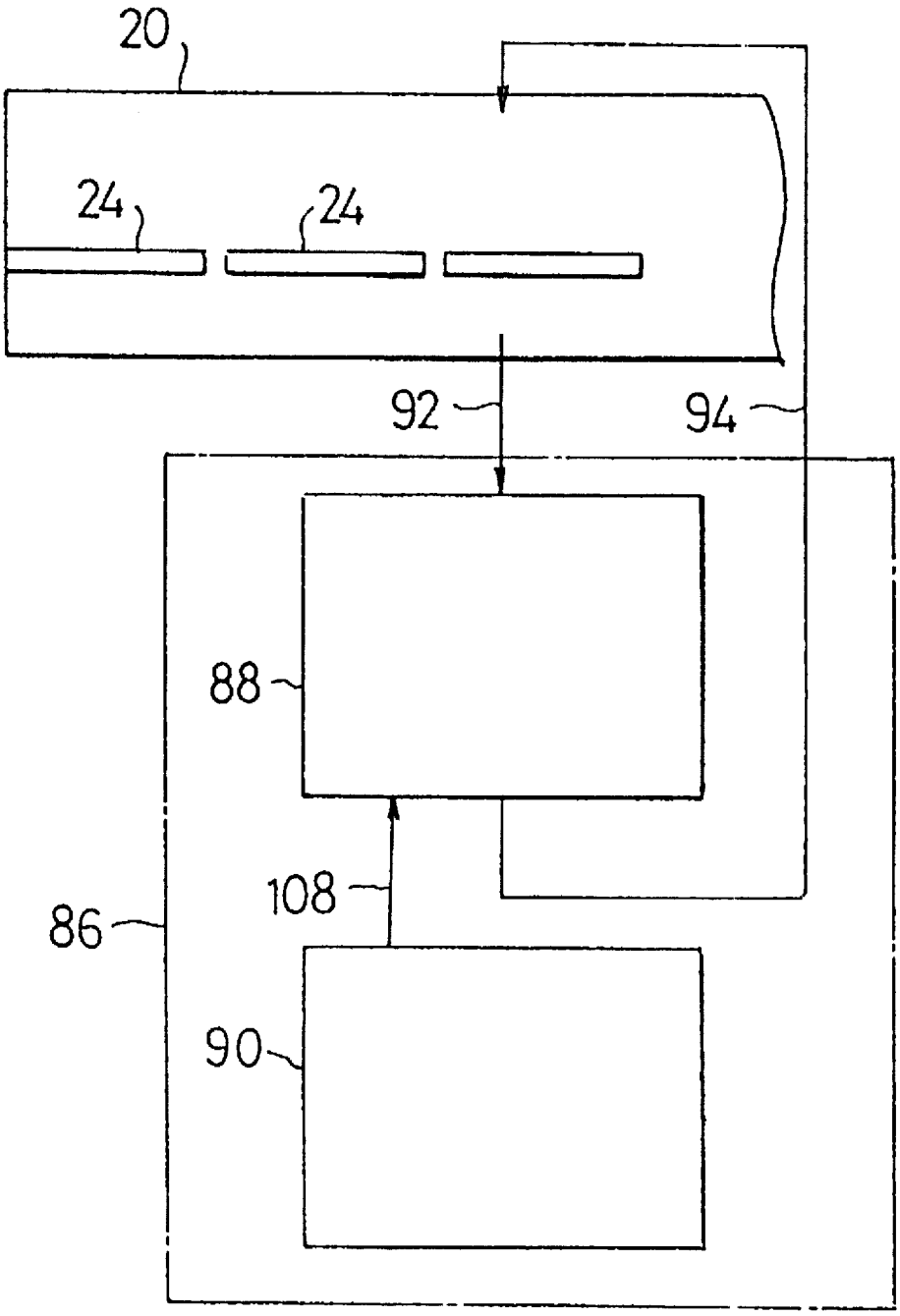
FIG. 11 is a schematic diagrammatic view generally showing a further embodiment of a calcination furnace according to the present invention which is provided with a furnace atmosphere control unit.

Referring now to FIG. 11, a further embodiment of a calcination furnace according to the present invention is schematically illustrated. A calcination furnace of the illustrated embodiment is constructed so as to permit combustion gas produced in a first furnace chamber section or calcination chamber to be utilized while preventing the combustion gas from adversely affecting calcination conditions.

More particularly, the calcination furnace of the illustrated embodiment includes in addition to a furnace body 20 in which a furnace chamber is defined, a furnace atmosphere control unit 86 which is adapted to feed the furnace body 20 with gas for a furnace atmosphere or an atmosphere in the furnace to control the furnace atmosphere. The furnace atmosphere control unit 86 includes a furnace atmosphere circulating section 88 for circulating the furnace atmosphere and a gas feed section 90 for feeding fresh gas to the furnace atmosphere. The furnace atmosphere circulating section 88 is constructed so as to adjust concentrations of components or ingredients of the atmosphere taken out thereto from the furnace body 20 through a takeout line 92, as well as adjust a temperature of the furnace atmosphere taken out to a level approximating a furnace temperature or a temperature in the furnace and then return the adjusted furnace atmosphere to the furnace body 20 through a return or feed line 94. Thus, the furnace atmosphere circulating section 88 permits thermal energy contained in the furnace atmosphere which is discarded in the conventional calcination furnace to be circulatedly utilized.

Further, as briefly described above, the furnace atmosphere circulating section 88 functions to adjust concentrations of ingredients of the furnace atmosphere taken out through the takeout line 92 thereto. For example, when the furnace atmosphere contains materials produced from calcined intermediate products 24 during calcination of the products 24, the furnace atmosphere circulating section 88 removes the materials from the furnace atmosphere and then return it to the furnace body 20. The materials produced from the products 24 include vapor of an organic binder and decomposition gas of the binder, as well as elements constituting the calcined intermediate product such as, for example, metals including Pb, K, Na, Mn and the like and oxides thereof. Also, for example, when the amount of combustion air is insufficient, the furnace atmosphere circulating section 88 replenishes it, resulting in preventing circulation of the furnace atmosphere from adversely affecting calcination of the intermediate products 24.

In addition, the furnace atmosphere circulating section 88 adjusts a temperature of the furnace atmosphere taken out from the calcination furnace through the takeout line 92 to a level approximating a furnace temperature and then returns it to the furnace, to thereby prevent the furnace chamber from being locally cooled or overheated, resulting in eliminating a variation in conditions for calcination of the calcined intermediate products and characteristics of final calcined products obtained. Preferably, the furnace atmosphere circulating section 88 adjusts the furnace atmosphere so that a difference between the temperature of the furnace atmosphere and the furnace temperature is below 50° C.

Now, the furnace atmosphere control unit 86 will be more detailedly described with reference to FIG. 12. The furnace atmosphere circulating section 88 includes an incineration section 96 for incinerating unnecessary ingredients contained in the furnace atmosphere taken out through the line 92. The incineration section 96 may comprise an electric heater or a combustion heater. In the illustrated embodiment, it comprises an electric heater, which is electrically connected to a power supply 98. Air required for incineration of the unnecessary ingredients is fed through a filter 99, a blower 100 and an electromagnetic valve 102 to the incineration section 96. The incineration section 96 is heated to a temperature required for incinerating decomposition gas of an organic binder and its vapor, as high as, for example, 750° to 800° C. The furnace atmosphere as taken out from the furnace body 20 through the line 92 has a temperature of 500° C. or below.

The furnace atmosphere circulating section 88 also includes a heat exchange section 104 for carrying out heat exchange between the incinerated furnace atmosphere taken out from the incineration section 96 through a line 106 and mixed gas fed to the heat exchange section 104 through a line 108 as described hereinafter. Further, the furnace atmosphere circulating section 88 further includes a mixing path for mixing fresh gas fed from the gas feed section 90 with the incinerated furnace atmosphere which has been passed through the heat exchange section 104 for the purpose of heat exchange with mixed gas described below. The path includes a cooler 112 and a blower 114. The cooler 112 functions to cool the furnace atmosphere incinerated in the section 96 and passed through the heat exchange section 104 to a level of, for example, about 50° C. and the blower 114 serves to forcibly feed the cooled furnace atmosphere through a line 116 to the line 108, wherein the cooled gas is mixed with the fresh gas fed from the gas feed section 90 thereto, resulting in mixed gas being prepared, which is then fed to the heat exchange section 104. The mixed gas is then subjected to heat exchange with the incinerated furnace atmosphere subsequently taken out from the incineration section 96 and then fed to the furnace body 20 through the return or feed line 94. Thus, it will be noted that in the illustrated embodiment, the gas circulating passage of the furnace atmosphere circulating section 88 is partly common to the gas feed passage of the gas feed section 90. The incineration section 96, as described above, heats the furnace atmosphere taken out from the furnace body 20 to a temperature as high as 750° to 800° C. required for incinerating decomposition gas of the organic binder and the like. Therefore, the incineration section 96 carries out rising in temperature of the furnace atmosphere as well as the incineration, so that it is possible to return the furnace atmosphere taken out from the incineration section 96 directly to the furnace body 20.

In the illustrated embodiment, the gas feed section 90 includes a first gas feed path 118 and a second gas feed path 120 each of which is arranged for feeding combustion air, nitrogen gas or the like. The first gas feed path 118 is provided with a filter 122 and an electromagnetic valve 124 and the second gas feed path 120 is likewise provided with a filter 126 and an electromagnetic valve 128.

Reference numeral 130 designates a monitor device for monitoring a concentration of the furnace atmosphere and 132 is a valve provided on an excessive gas discharge line 133. The monitor device 130 monitors concentrations of ingredients contained in the furnace atmosphere cooled by the cooler 112, to thereby control a degree of opening of the electromagnetic valves 124 and 128 or the number of operations thereof, resulting in a concentration of the furnace atmosphere in the furnace body 20 being adjusted. For example, it monitors a ratio of air to nitrogen in the furnace atmosphere.

Figure 12:
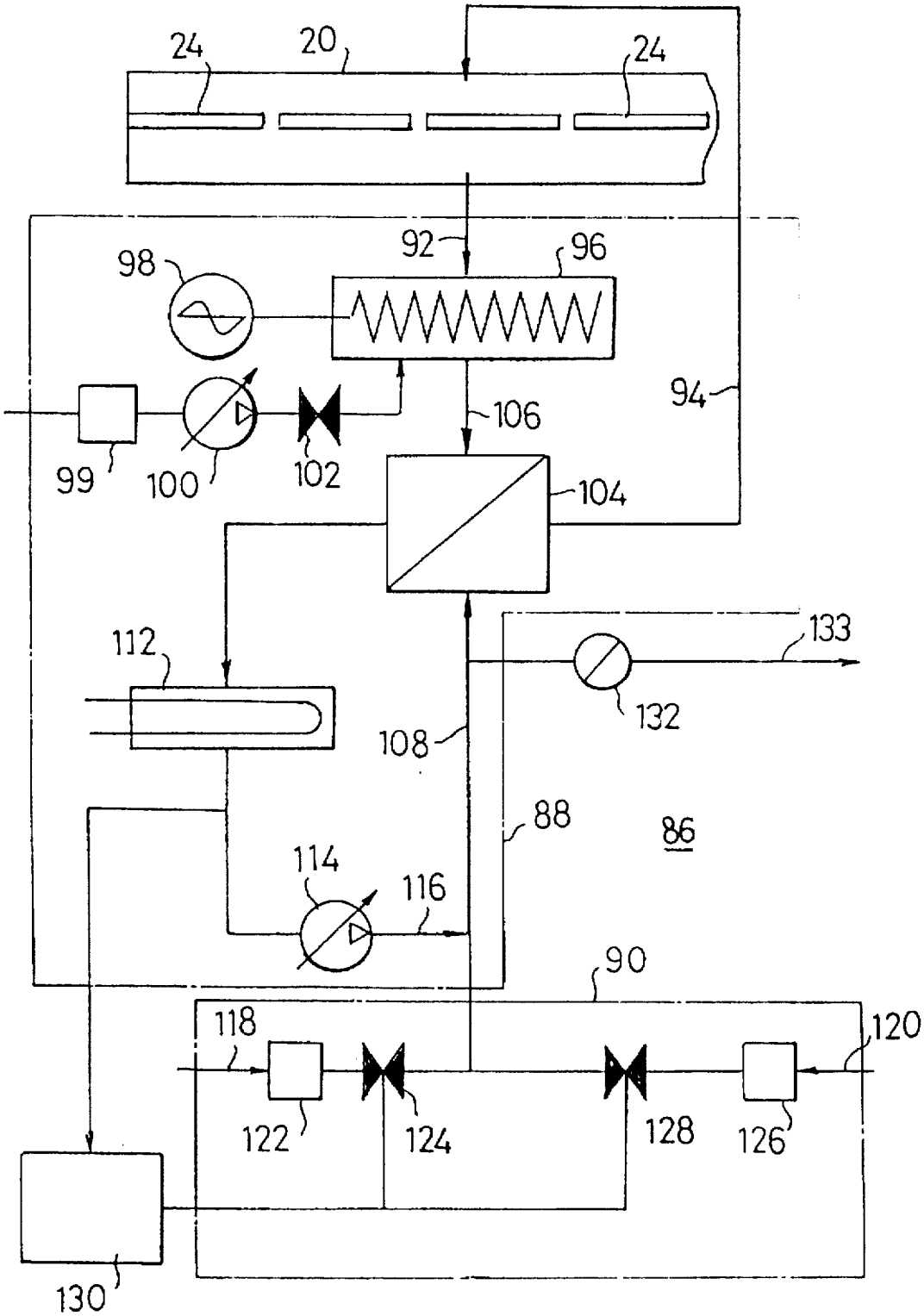
FIG. 12 is a schematic diagrammatic view generally showing a modification of the calcination furnace of FIG. 11.
Figure 13:
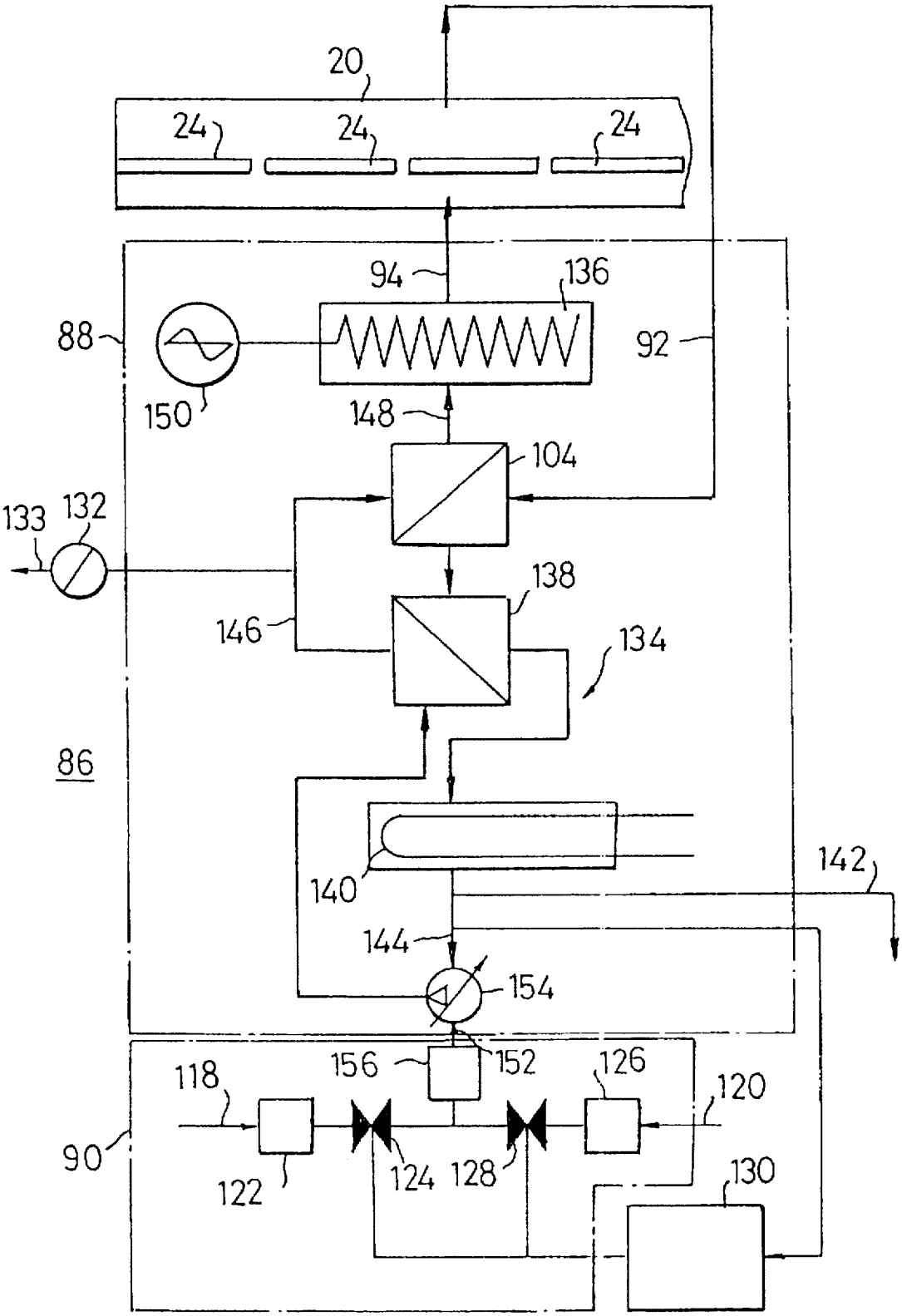
FIG. 13 is a schematic diagrammatic view generally showing another modification of the calcination furnace of FIG. 11.

FIG. 13 shows a modification of the embodiment shown in FIGS. 11 and 12. In a furnace atmosphere control unit 86 of the modification, a furnace atmosphere circulating section 88 includes a cooling device 134 and a heat-up device 136. The cooling device 134 functions to condense an organic binder contained in a furnace atmosphere taken out from a furnace body 20 through a take-out line 92. The cooling device 134 includes a heat exchanger 138 for reducing a temperature of the furnace atmosphere taken out and a cooler 140 for further cooling the furnace atmosphere to a condensation temperature. When decomposition gas of an organic binder produced during calcination of calcined intermediate products made of a ceramic material is to be condensed, the furnace atmosphere is cooled to a temperature as low as −30° C. by the cooler 140. The heat exchanger 138 may be replaced with a cooler. Ingredients thus condensed are recovered through a discharge path 142.

The furnace atmosphere cooled through the cooling device 134 is then guided through a line 144 to the heat exchanger 138, to thereby be increased in temperature. Then, the furnace atmosphere is fed to a heat exchange section 104 through a line 146, to thereby be further increased in temperature. The furnace atmosphere is then guided through a line 148 to the heat-up device 136, which heats the furnace atmosphere, and then returned to the furnace body 20. The heat exchange section 42 carries out heat exchange between the furnace atmosphere as taken out from the furnace body 20 and the gas guided from the heat exchange 138 to heat-up device 136. Reference numeral 150 designates a power supply electrically connected to the heat-up device 136. The furnace atmosphere circulating section 88 further includes a path for mixing fresh gas fed from a gas feed section 90 through a feed line 152 with the cooled gas flowing through the line 144. Gas thus mixed is then fed to heat exchanger 138 by means of a blower 154. The feed line 152 is provided with a filter 156.

The remaining part of the modification may be constructed in substantially the same manner as the calcination furnace of FIGS. 11 and 12.

Figure 14:
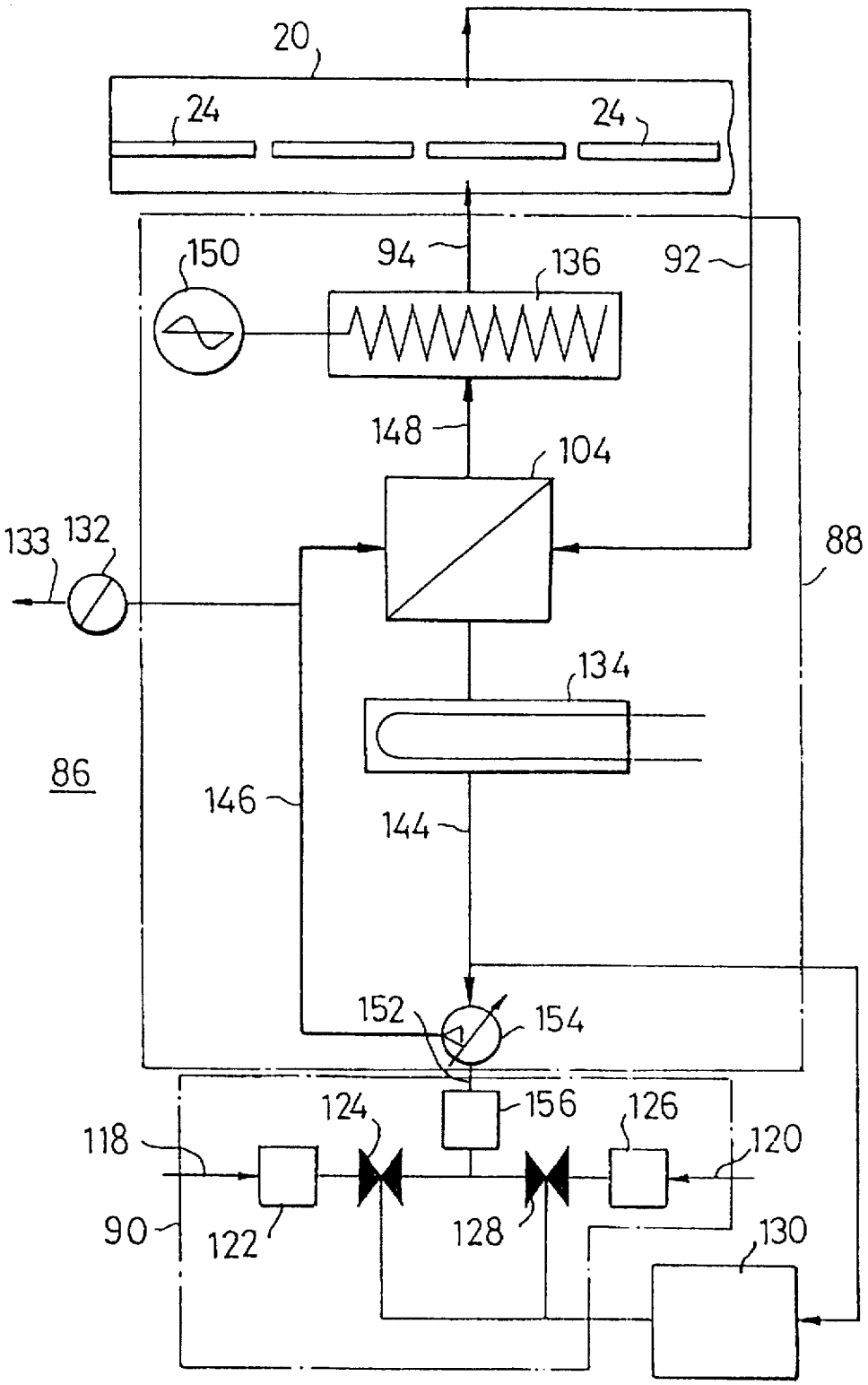
FIG. 14 is a schematic diagrammatic view generally showing a further modification of the calcination furnace of FIG. 11.

FIG. 14 shows another modification of the embodiment shown in FIGS. 11 and 12. In a calcination furnace of the modification, a single cooling device 134 is provided. The modification is adapted to treat a furnace atmosphere free of an impurity, an organic binder and the like. The remaining part of the modification may be constructed in substantially the same manner as the calcination furnace of FIG. 13.

Figure 15:
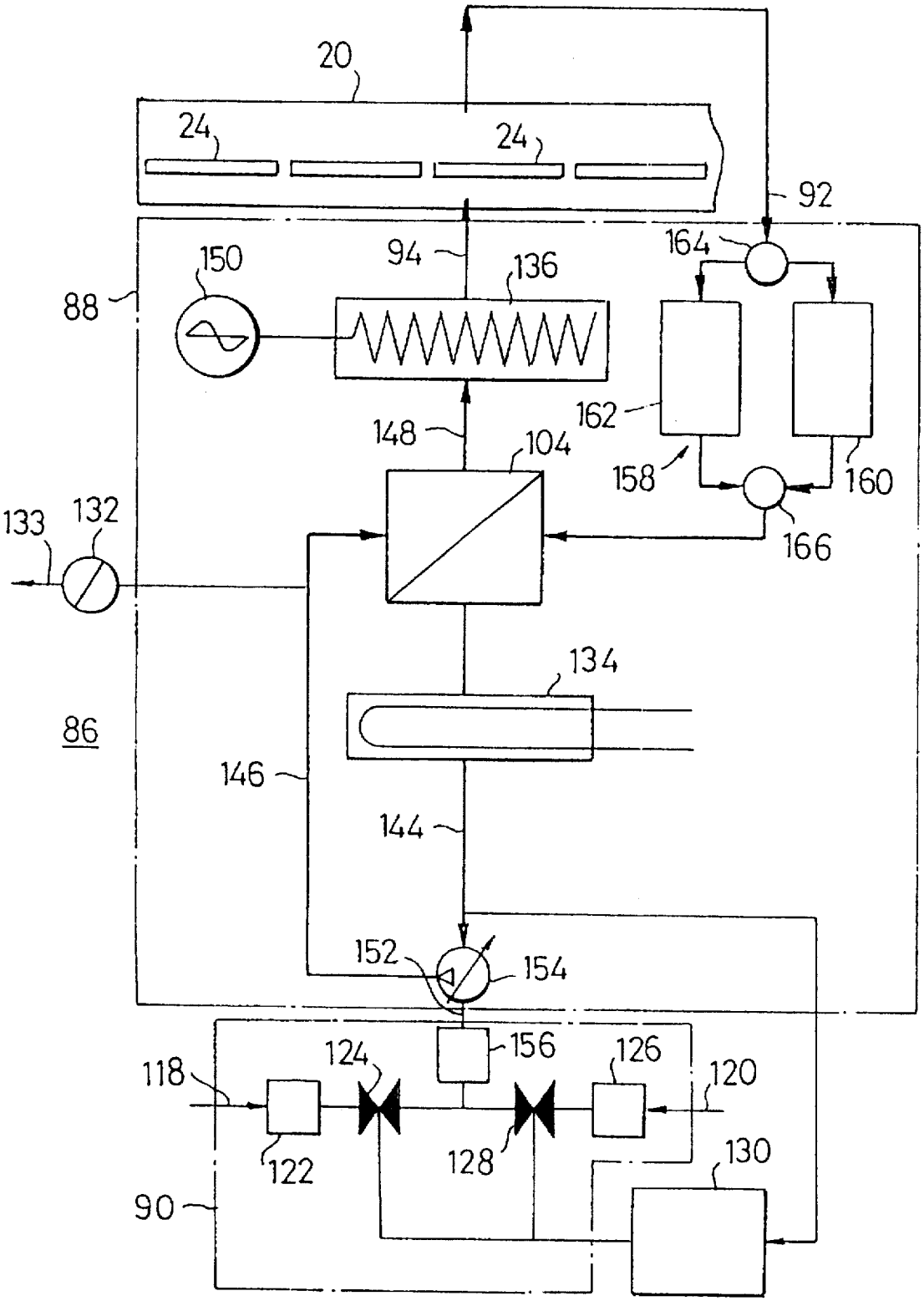
FIG. 15 is a schematic diagrammatic view generally showing still another modification of the calcination furnace of FIG. 11.

FIG. 15 shows a further modification of the embodiment shown in FIGS. 11 and 12. A calcination furnace of the modification includes a vapor recovery unit 158 for recovering metal ingredients such as Pb, K, Na, Mn and the like and/or oxides thereof by deposition. The vapor recovery unit includes two vapor recovery sections 160 and 162 arranged in parallel to each other, which are alternately operated while being changed over by changing-over cocks 164 and 166.

Figure 16:
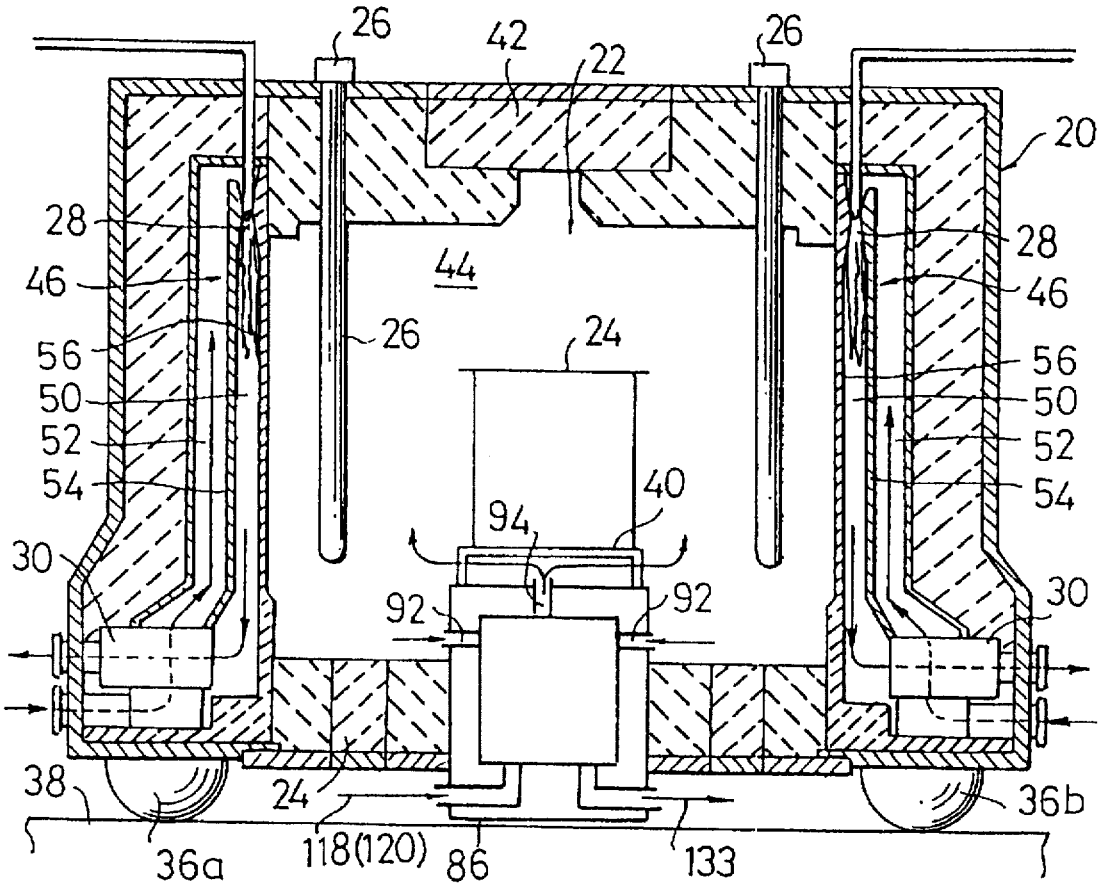
FIG. 16 is a schematic diagrammatic view generally showing a still further modification of the calcination furnace of FIG. 11.

The furnace atmosphere control units 86 shown in FIGS. 11 to 15 each may be disposed outside the furnace body 20 of the calcination furnace. Alternatively, at least a part of the furnace atmosphere control unit 86 may be incorporated in or integrated with the furnace body 20. FIG. 16 shows an example of the furnace atmosphere control unit 86 of which a part is incorporated in the furnace body. The furnace atmosphere control unit 86 may take any form shown in FIGS. 11 to 15. In the calcination furnace shown in FIG. 16, partitions 54 and 56 each comprise an indirect radiation wall. The indirect radiation walls are arranged so as to account for at least 50% of an area of a calcination chamber 44. Such arrangement permits controlling of a temperature in a first furnace chamber section 44 to be facilitated. The remaining part of the calcination furnace shown in FIG. 16 may be constructed in substantially the same manner as that shown in FIG. 4.

As can be seen from the foregoing, the embodiment shown in FIGS. 11 to 15 is so constructed that the furnace atmosphere taken out from the calcination furnace is returned to the calcination furnace through the furnace atmosphere circulating section 88 of the furnace atmosphere control unit 86, to thereby improve heat efficiency of the calcination furnace. Also, the furnace atmosphere circulating section 88 adjusts concentrations of ingredients contained in the furnace atmosphere taken out from the furnace body 20, so that return of the furnace atmosphere to the furnace body 20 does not adversely affect calcination of the intermediate products. Further, the furnace atmosphere circulating section 88 heats the furnace atmosphere taken out from the furnace body 20 to a temperature approximating to a furnace temperature, followed by returning it to the furnace body, to thereby prevent local cooling or heating the furnace chamber. This results in a variation in calcination conditions and a variation in characteristics of the final calcined products being effectively prevented.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A calcination furnace comprising:

a furnace body in which a furnace chamber is defined;

a heat source for heating said furnace chamber, including first and second heat source means;

said furnace chamber including a first furnace chamber section and at least one second furnace chamber section, said first furnace chamber section receiving therein a calcined intermediate product and said second furnace chamber section being partitioned from said first furnace chamber section; and said first furnace chamber section being provided with said first heat source means and said second furnace chamber being provided with said second heat source means.

2. A calcination furnace as defined in claim 1, wherein said furnace body includes at least one movable section for adjusting an internal volume of said furnace chamber and the first and second heat source means include at least one combustion chamber.

3. A calcination furnace as defined in claim 1, wherein said first heat source means comprises electric heaters and said second heat source means comprises combustion heaters.

4. A calcination furnace as defined in claim 3, wherein said second furnace chamber section includes a combustion chamber and an air feed path communicating with each other;

said combustion chamber constituting a combustion space for said second heat source means;

said air feed path feeding combustion air from an ambient atmosphere therethrough to said combustion chamber.

5. A calcination furnace as defined in claim 4, further comprising a heat exchange means for carrying out heat exchange between air introduced into said air feed path and combustion gas discharged from said combustion chamber.

6. A calcination furnace as defined in claim 5, wherein said heat exchange means includes air passages and combustion gas passages;

said air passages being arranged so as to communicate with an ambient atmosphere and said air feed path and said combustion gas passage being arranged so as to communicate with said combustion chamber and be adjacent to said air passages.

7. A calcination furnace as defined in claim 5, wherein said heat exchange means is provided at said furnace body.

8. A calcination furnace as defined in claim 1, wherein said furnace chamber includes a first furnace chamber section constituting a calcination chamber and at least one second furnace chamber section;

said second furnace chamber section including a combustion heater means;

said second furnace chamber section being arranged adjacent to said calcination chamber and partitioned from said calcination chamber through a heat transfer partition.

9. A calcination furnace as defined in claim 8, wherein said second furnace chamber section is arranged on at least one side of said calcination chamber; and said heat transfer partition forms a part of a wall of said calcination chamber.

10. A calcination furnace as defined in claim 8, wherein said second furnace chamber section is arranged on each of both sides of said calcination chamber; and said heat transfer partition forms a part of a wall of said calcination chamber.

11. A calcination furnace as defined in claim 9, wherein said heat transfer partition accounts for at least 40% of an area of said wall of said calcination chamber.

12. A calcination furnace as defined in claim 8, wherein said second furnace chamber section is provided therein with an air feed path for introducing air from an ambient atmosphere therethrough to said second furnace chamber section.

13. A calcination furnace as defined in claim 12, wherein said second furnace chamber section is divided into first and second chamber portions through a partition;

said first chamber portion constituting a combustion chamber in which said combustion heater means is arranged and said second chamber portion constitutes said air feed path.

14. A calcination furnace as defined in claim 13, wherein said first chamber portion is arranged adjacent to said calcination chamber and said second chamber portion is arranged opposite to said calcination chamber through said first chamber portion interposed therebetween.

15. A calcination furnace as defined in claim 8, further comprising an additional heat source means arranged in said calcination chamber.

16. A calcination furnace as defined in claim 15, wherein said additional heat source means comprises an electric heater means.

17. A calcination furnace as defined in claim 4, further comprising a combustion heater means for heating said furnace chamber; and a heat exchange means incorporated into said furnace body so as to carry out heat exchange between combustion air introduced into said furnace chamber and combustion gas discharged from said furnace chamber.

18. A calcination furnace as defined in claim 17, wherein said heat exchange means includes combustion air passages and combustion gas passages arranged adjacent to each other.

19. A calcination furnace as defined in claim 17, wherein said furnace chamber is defined by a heat transfer wall and a reflection wall;

said combustion heater means being arranged so as to heat said furnace chamber through said heat transfer wall.

20. A calcination furnace as defined in claim 1, wherein said furnace chamber includes at least one furnace chamber section; and said furnace chamber section being divided into a plurality of regions in which calcined intermediate products are received;

said regions being arranged so as to cause heat interference to occur among said regions;

said regions being provided therein with heat source units, respectively;

said heat source units being driven while exhibiting time-temperature characteristic patterns in which exotherm is varied with time so as to cause a time delay to occur among the time-temperature characteristic patterns.

21. A calcination furnace as defined in claim 20, wherein said regions are arranged in a row in one direction; and said heat source units are driven so as to cause said time delay to occur in the direction of arrangement of said heat source units.

22. A calcination furnace as defined in claim 21, wherein said furnace chamber section is divided into three said regions.

23. A calcination furnace as defined in claim 1, further comprising a furnace atmosphere control unit which includes a furnace atmosphere circulating section;

said furnace atmosphere circulating section being constructed so as to adjust a concentration of ingredients contained in a furnace atmosphere taken out from said furnace body and adjust a temperature of the furnace atmosphere to a level approximating a furnace temperature in said furnace body before the furnace atmosphere is returned to said furnace body.

24. A calcination furnace as defined in claim 23, wherein said furnace atmosphere circulating section includes a mixing path for mixing the furnace atmosphere incinerated with fresh gas fed to said furnace atmosphere circulating section to prepare mixed gas.

25. A calcination furnace as defined in claim 24, wherein said furnace atmosphere circulating section includes a cooler for cooling the furnace atmosphere incinerated, which is then mixed with the fresh gas.

26. A calcination furnace as defined in claim 23, wherein said furnace atmosphere circulating section includes a cooling device and a heat-up device;

said cooling device removing ingredients contained in the furnace atmosphere by condensation and said heat-up device functioning to heat the furnace atmosphere cooled by said cooling device.

27. A calcination furnace as defined in claim 26, wherein said furnace atmosphere circulating section includes a heat exchanger for carrying out heat exchange between the furnace atmosphere taken out from said furnace body and gas fed to said furnace body and heating the gas;

said heat-up device heating the gas.

28. A calcination furnace comprising:

a furnace chamber including at least one furnace chamber section; and heat source units;

said furnace chamber section being divided into a plurality of regions in which calcined intermediate products are received;

said regions being arranged so as to cause heat interference to occur among said regions;

said heat source units being arranged in said regions of said furnace chamber section, respectively;

said heat source units being driven while exhibiting time-temperature characteristic patterns in which exotherm is varied with time so as to cause a time delay to occur among the time-temperature characteristic patterns.

29. A furnace atmosphere control unit for a calcination furnace comprising:

a furnace atmosphere circulating section;

said furnace atmosphere circulating section being constructed so as to adjust a concentration of ingredients contained in a furnace atmosphere taken out from a furnace body of the calcination furnace and adjust a temperature of the furnace atmosphere to a level approximating a furnace temperature in said furnace body before the furnace atmosphere is returned to said furnace body.

30. A calcination furnace comprising:

a furnace body in which a furnace chamber is defined, said furnace chamber including a first furnace chamber section constituting a calcination chamber and at least one second furnace chamber section;

said second furnace chamber section including a combustion heater means;

said second furnace chamber section being arranged adjacent to said calcination chamber and partitioned from said calcination chamber through a heat transfer partition; and an additional heat source means arranged in said calcination chamber.

* * * * *